US005530524A

United States Patent [19]

Tsujita et al.

[11] Patent Number: 5,530,524

[45] Date of Patent: Jun. 25, 1996

[54] ELECTROPHOTOGRAPHIC APPARATUS WITH PHOTOSENSITIVE DRUM REQUIRING MULTIPLE ROTATIONS FOR PRODUCTION OF A COPY IMAGE ON ONE SHEET AND METHOD OF OPERATING SAME

[75] Inventors: Mitsuji Tsujita; Keizo Kimoto; Ichiro Yamazato; Nariaki Tanaka; Tomoki Tanaka, all of Osaka, Japan

[73] Assignee: Mita Industrial Co., Ltd., Osaka, Japan

[21] Appl. No.: 207,166

[22] Filed: Mar. 8, 1994

[30] Foreign Application Priority Data

Mar. 9, 1993 [JP] Japan ..... 5-048089

[51] Int. Cl.[6] ..... G03G 15/00; G03G 21/00

[52] U.S. Cl. ..... 355/211; 355/214

[58] Field of Search ..... 355/208, 214, 355/211, 212

[56] References Cited

U.S. PATENT DOCUMENTS 4,821,068 4/1989 Honma et al. ..... 355/214 X 4,870,460 9/1989 Harada et al. ..... 355/246 X 4,985,730 1/1991 Ohba et al. ..... 355/208

5,107,302 4/1992 Bisaiji ..... 355/214 X 5,386,279 1/1995 Fukami et al. ..... 355/271

*Primary Examiner*—Fred L. Braun

*Attorney, Agent, or Firm*—Sherman and Shalloway

[57] ABSTRACT

A compact electrophotographic apparatus is attained by decreasing the diameter of the photosensitive drum so that a plurality of rotations of the drum are required to produce a single sheet image. Images of excellent quality, especially with respect to the lack of stepwise density decrease across the image due to multiple drum rotations per image, are achieved by providing for discharge of the photosensitive drum so that the residual potential on the drum is 10% or less of the charged surface potential after discharge on the first rotation of the drum and the increase in the residual potential is not more than 30% after discharge on the last rotation of a sheet making cycle.

12 Claims, 10 Drawing Sheets

ELECTROPHOTOGRAPHIC APPARATUS WITH PHOTOSENSITIVE DRUM REQUIRING MULTIPLE ROTATIONS FOR PRODUCTION OF A COPY IMAGE ON ONE SHEET AND METHOD OF OPERATING SAME

BACKGROUND OF THE INVENTION

1. Field of the Invention

The present invention relates to an electrophotographic apparatus using an organic single-layer photosensitive drum. More specifically, the invention relates to an electrophotographic apparatus which is capable of forming an image of excellent quality by using a photosensitive drum of a small diameter.

2. Description of Prior Art

Photosensitive materials which are commercially used for electrophotography include selenium photosensitive materials, amorphous silicon (a-Si) photosensitive materials and organic photosensitive materials. Among them, the organic photosensitive materials are widely used for the applications of personal copies and the like from the overall standpoint of sensitivity, cost, etc.

The organic photosensitive materials are, in many cases, of the so-called function separation type, i.e., the laminated type in which a charge generating layer (CGL) and a charge transporting layer (CTL) are laminated one upon the other. There has further been used an organic photosensitive material of the single-layer dispersion type in which the charge generating substance is dispersed in the charge transporting medium.

The size of the electrophotographic apparatus can be effectively decreased by decreasing the volume occupied by the photosensitive drum, i.e., by decreasing the size of the drum. When the diameter of the drum is decreased, however, a complete image is formed by revolving the drum many times; i.e., the steps of uniform charging, exposure to image, developing, transfer, cleaning and discharging necessary for forming the image must be carried out for many times of revolutions of the drum.

It was, however, found that when a complete image is formed by revolving the organic single-layer photosensitive drum many times, the image density decreases stepwisely depending upon the number of revolutions of the drum.

Though the degree of stepwise decrease in the image density is small, a change in the density on a piece of a copy can be clearly discerned even by the naked eye. This change appears considerably clearly on the solid portion of the image, and it has been urged to solve this problem.

When the image-forming cycle is repeated many times for the above-mentioned organic single-layer photosensitive drum and the a-Si photosensitive material, in particular, the surface potential at the developing portion decreases considerably due to dark attenuation resulting in a great decrease in the image density.

SUMMARY OF THE INVENTION

The object of the present invention, therefore, is to provide an electrophotographic apparatus which uses a photosensitive drum of a small diameter and forms a complete image by revolving the drum many times, wherein the stepwise decrease in the image density that results from the number of revolutions of the drum is suppressed and, as a result, an image is obtained having uniform image density and image quality.

Another object of the present invention is to provide an electrophotographic apparatus which suppresses the drop of a surface potential due to an increase in the dark attenuation to a very low level even after the image-forming cycle is repeated many times by using the above-mentioned photosensitive material, and exhibits excellent abrasion resistance.

According to the present invention, there is provided an electrophotographic apparatus for forming image by subjecting a photosensitive drum to charging, to exposure to an image and to discharging, wherein the photosensitive drum has a small outer diameter drum having a circumferential length shorter than ½ of the image size in the drum rotating direction, the photosensitive drum and the image-forming cycle are so related to each other that a complete image is formed after the drum is revolved many times, and the amount of discharge is so set that in forming a complete image, the residual potential is 10% or less of the charged surface potential after the discharge of the first time of revolution, and an increase in the residual potential is not more than 30% after the discharge of the last time of revolution.

Figure 1:
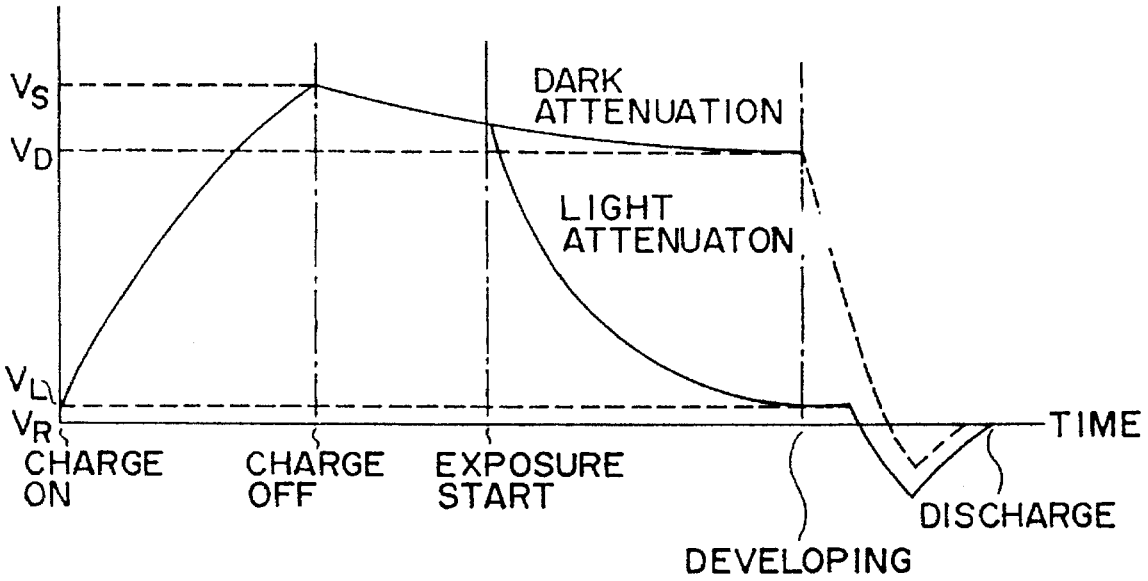
FIG. 1 is a diagram which schematically illustrates the state,of surface potential of the photosensitive material in an electrophotographic processing.

Description of Reference Numerals:

1 positively charged-type organic photosensitive drum
2 positive corona-charging mechanism
3 probe for detecting surface potential
4 exposure/discharge mechanism
5 probe for detecting residual potential after the discharge
6 drum
7 tungsten wire
8 shielding case
9 corona charger
10 high voltage generating device
11 bias power source

DETAILED DESCRIPTION OF THE PREFERRED EMBODIMENTS

The present inventors have discovered the fact that the image density that stepwisely decreases depending upon the number of revolutions when a complete image is formed by revolving many times the photosensitive drum of a small diameter, results from the stepwise decrease in the potential on the surface of the drum.

The inventors have further studied the case of the stepwise decrease in the potential on the drum surface that corresponds to the number of revolutions of the drums, and have discovered the fact that a decrease in the surface potential is closely related to the residual potential on the drum surface of before being charged.

Referring to FIG. 1 which schematically illustrates the state of voltages on the surface of the photosensitive material in the electrophotographic processing, the ordinate represents the potential on the surface of the photosensitive material and the abscissa represents the time in relation to the processing steps.

First, upon turning the charge ON, the potential on the surface of the photosensitive material reaches a saturation potential Vs and after the charge is turned OFF, the surface potential decreases due to dark attenuation. Upon turning the exposure ON, the surface potential suddenly decreases on a bright portion L depending upon the sensitivity characteristics of the photosensitive material but the surface potential on a dark portion D keeps up with dark attenuation. After the exposure is turned OFF, the steps of developing and cleaning are carried out. The surface potential $V_D$ on the dark portion at the time of developing has a relation to the image density, and a difference from the developing bias potential gives a predetermined contrast. Finally, upon discharging the photosensitive material, the potential on the surface of the photosensitive material reaches a certain residual potential $V_R$ and, then, the aforementioned steps are repeated.

in the case of the organic single-layer photosensitive material, for instance, the saturation potential $V_S$ is usually of the order of from 500 to 1000 V and the residual potential $V_R$, on the other hand, is of the order of from 10 to 80 V though they may vary depending upon the kind of the photosensitive material. This is because, though the residual potential $V_R$, in principle, can be brought to a value close to zero, it has been considered that as the quantity of light for discharging increases too much, troubles arouse due to optical wear and generation of light carriers and there is, on the other hand, virtually no problem if the discharging is effected to a degree of the above-mentioned potential difference.

Figure 2:
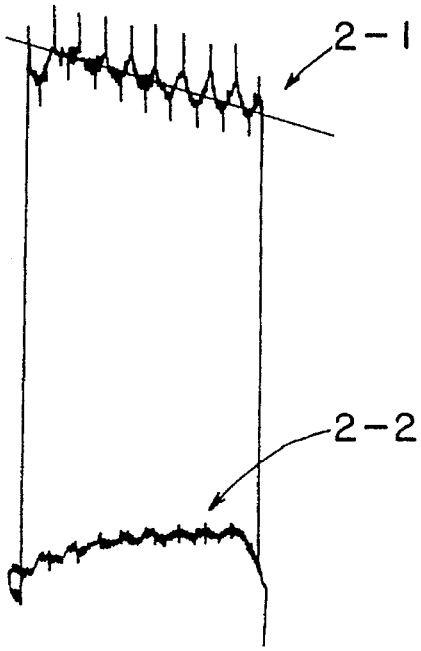
FIG. 2 PRIOR ART
FIG. 2 is a graph illustrating a relationship between the potential on the surface of the drum and the surface potential after the discharging by exposure as measured by using a measuring device shown in FIG. 4 under the conditions of Comparative Example 1.

The accompanying drawings (FIGS. 2 and 3) are graphs illustrating relationships between the potential on the surface of the drum and the surface potential after the discharge by exposure using a positively charged-type organic photosensitive drum having a diameter of 30 mm (for details, refer to Comparative Example 1 and Example 1 appearing later) as measured by using a measuring device shown in FIG. 4, and wherein the ordinate represents the potential and the abscissa represents the time. In these drawings, a curve (2-1 or 3-1) represents the potential on the surface of the drum and a curve (2-2 or 3-2) represents the residual potential after the discharge. The peaks of the curve (2-1 or 3-1) correspond to the revolutions of the drum 1. FIG. 2 illustrates an example according to a prior art wherein the potential on the surface of the drum is stepwisely decreasing depending upon the number of revolutions of the drum, and FIG. 3 illustrates an example of the present invention wherein the potential on the surface of the drum is suppressed from stepwisely decreasing but stably remains at a given value irrespective of the number of revolutions.

Figure 4:
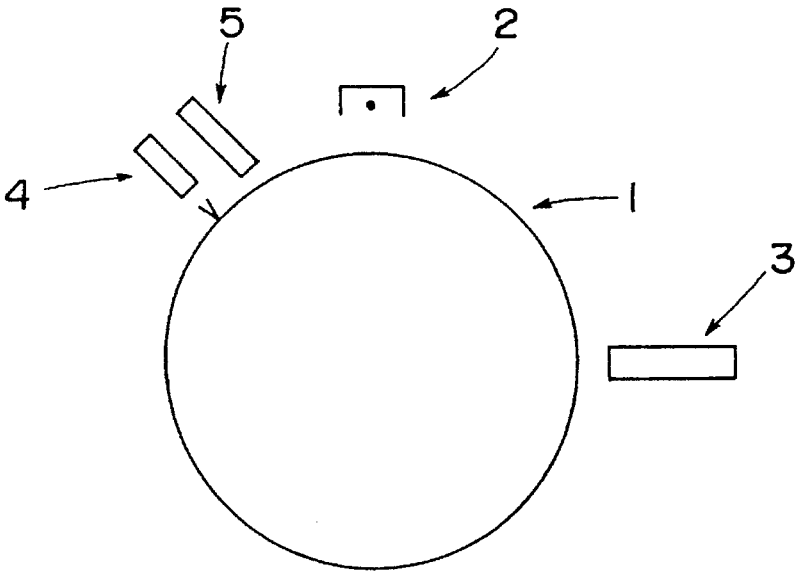
FIG. 4 is a diagram of arrangement illustrating the measuring device.

The measurement was taken by repeating the charge and discharge by exposure by rotating the positively charged-type organic photosensitive drum 1 which is surrounded as shown in FIG. 4 by a positive corona-charging mechanism, a probe 3 for detecting the surface potential, an exposure/discharge mechanism 4, and a probe 5 for detecting the residual potential after the discharge.

Figure 3:
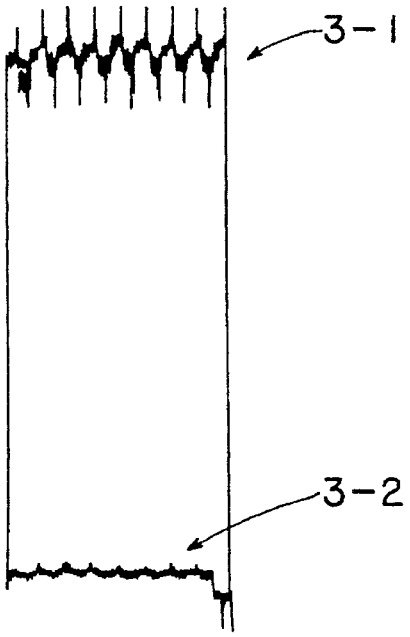
FIG. 3 is a graph illustrating a relationship between the potential on the surface of the drum and the surface potential after the discharging by exposure as measured by using a measuring device shown in FIG. 4 under the conditions of Example 1.

The results indicate an astonishing fact that when the potential on the surface of the drum stepwisely decreases depending upon the number of revolutions of the drum, the residual potential is generally high after the discharge and, still, increases due to the accumulation of the residual potential as the number of revolutions increases (FIG. 2), whereas when the potential on the surface of the drum remains constant irrespective of the number of revolutions, the residual potential is low after the discharge and is not almost caused to be increased by the accumulation of the residual potential despite an increase in the number of revolutions (FIG. 3).

Based on the above-mentioned experimental results according to the present invention, the amount of discharge is so set that in forming a complete image, the residual potential is 10% or less of the charged surface potential after the discharge of the first time of revolution, and an increase in the residual potential is not more than 30% after the discharge of the last time of revolution. Therefore, the surface potential is suppressed from being stepwisely decreased by the number of revolutions, the density of a complete image is prevented from stepwisely decreasing and, thus, the invention has succeeded in forming an image having uniform density and quality.

According to the present invention, furthermore, the photosensitive drum has a small diameter with a circumferential length shorter than ½ of the image size in the rotating direction of the drum (for example, when a paper of A4 size is used by conveying it in the lengthwise direction of the paper, a photosensitive drum having a diameter of 40 mm or less, especially 30 mm or less), and a complete image is formed by revolving the drum many times. Therefore, the apparatus, as a whole, can be markedly decreased in size, enabling the personal copying machine to be installed on a compact area or to be realized in a compact volume, lending itself well for being incorporated in a facsimile, a laser printer or a like apparatus.

Figure 5:
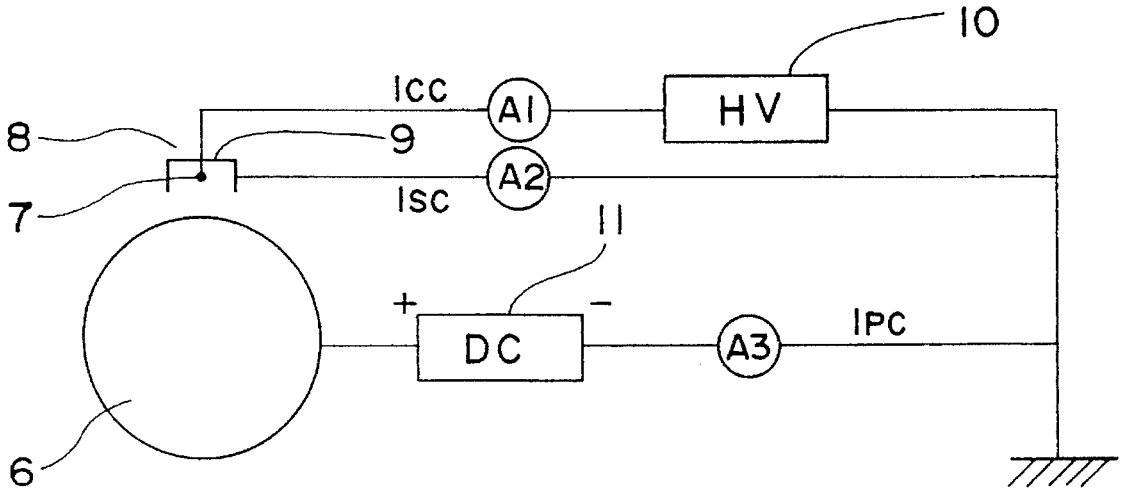
FIG. 5 is a circuit diagram for explaining the principle of experiment.
Figure 6:
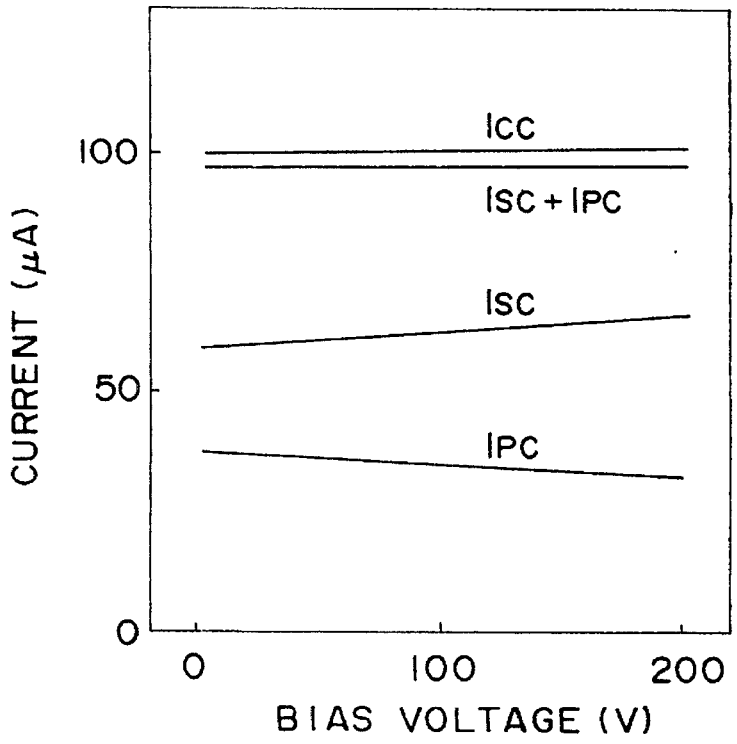
FIG. 6 is a graph showing currents Isc and Ipc of the case of ICC (100 μA) while changing the bias voltage by using FIG. 5.
Figure 7:
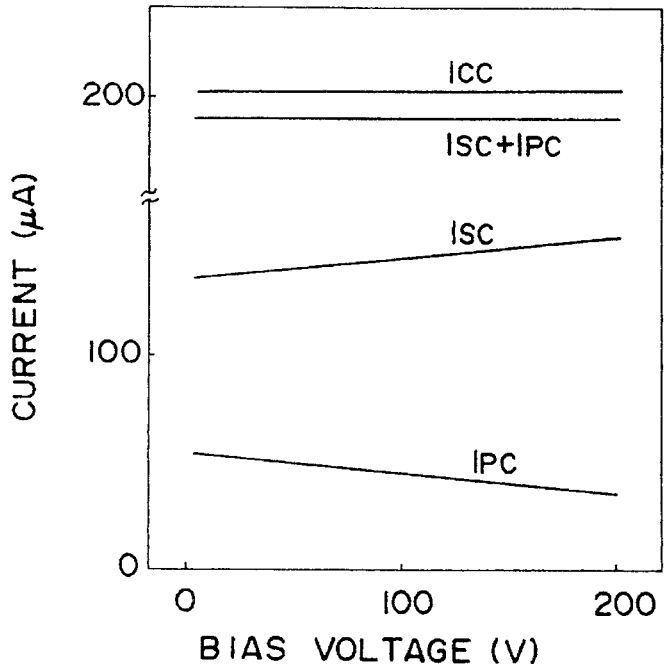
FIG. 7 is a graph showing currents Isc and Ipc of the case of ICC (200 μA) while changing the bias voltage by using FIG. 5.
Figure 8:
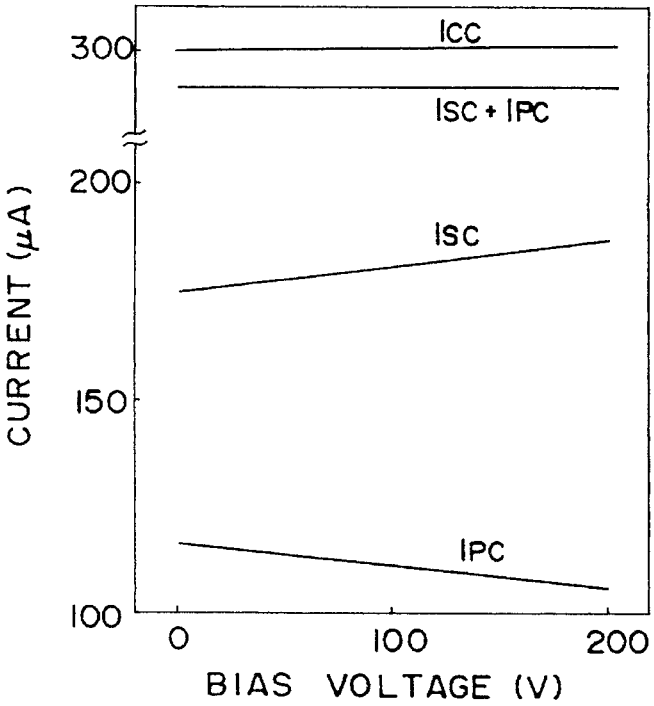
FIG. 8 is a graph showing currents Isc and Ipc of the case of ICC (300 μA) while changing the bias voltage by using FIG. 5.
Figure 9:
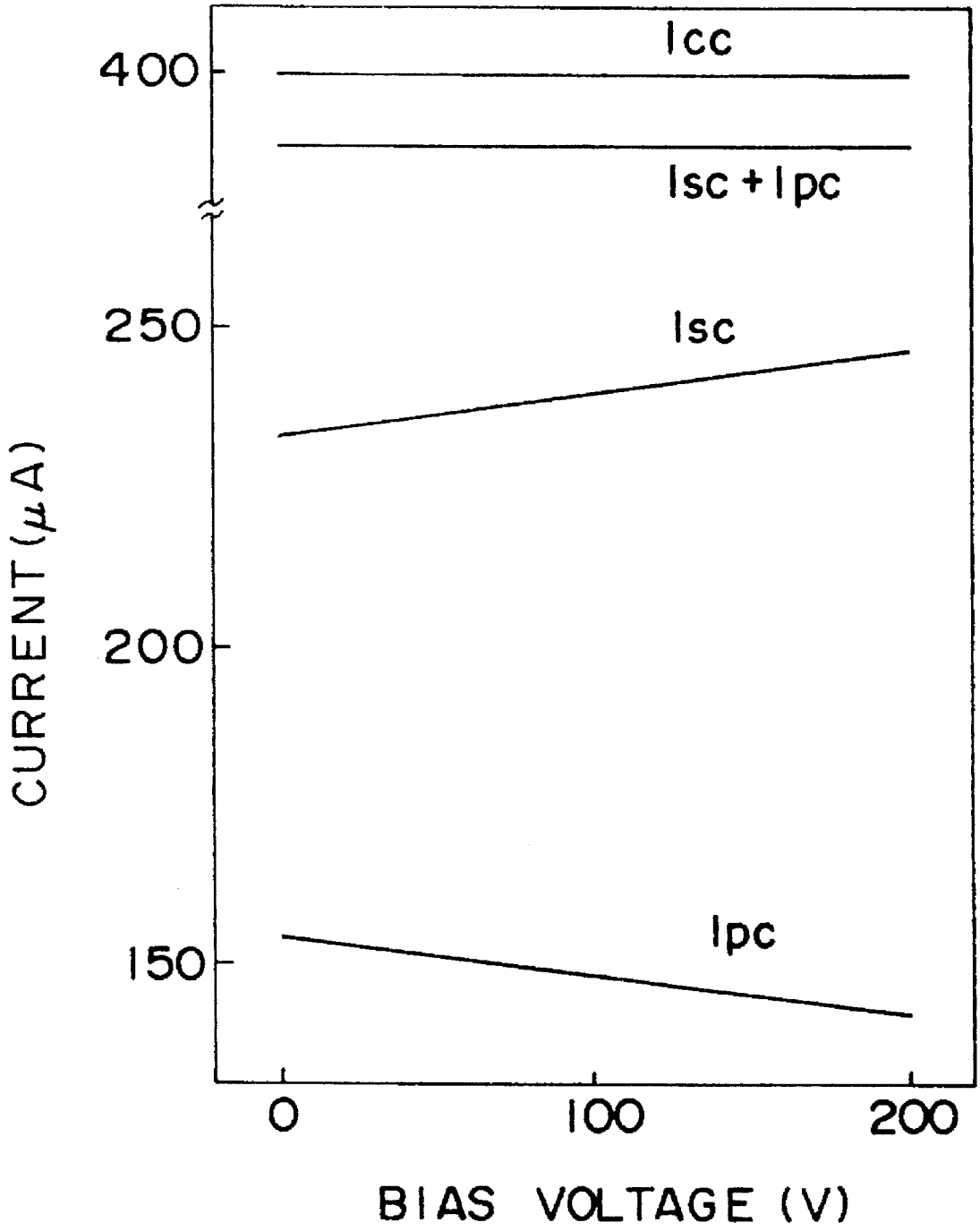
FIG. 9 is a graph showing currents Isc and Ipc of the case of ICC (400 μA) while changing the bias voltage by using FIG. 5.
Figure 10:
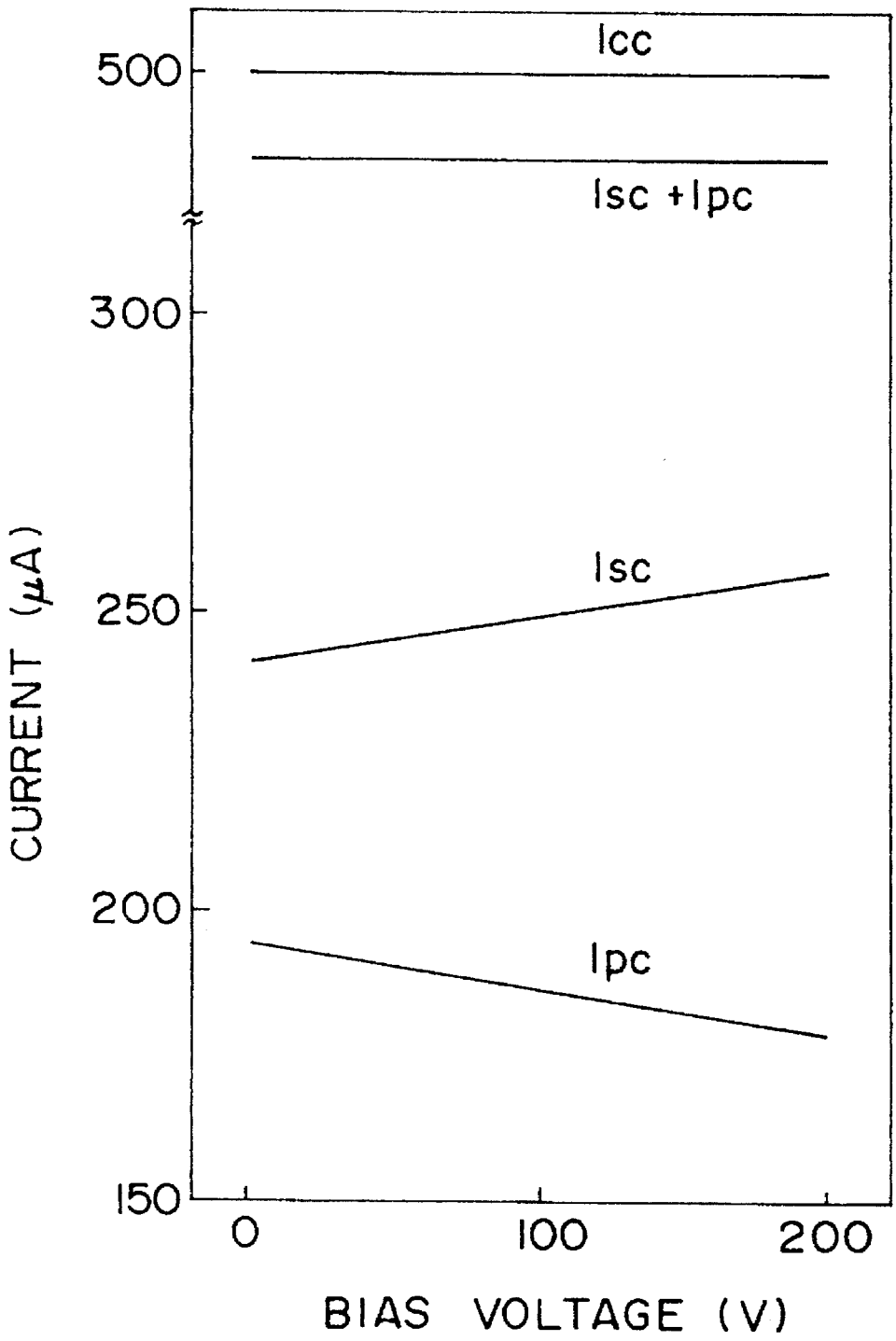
FIG. 10 is a graph showing currents Isc and Ipc of the case of ICC (500 μA) while changing the bias voltage by using FIG. 5.

The present inventors have further conducted the following experiments in order to find the cause of effect upon the surface potential by the residual potential after the discharge when a complete image is being formed by revolving the photosensitive drum many times. As a result, the inventors have discovered the following interesting fact. That is, with reference to FIG. 5 explaining the principle of the experiments, a corona charger 9 made up of a tungsten wire 7 and a shielding case 8 is disposed around a drum 6 made of an aluminum blank tube, a high-voltage generating device (HV) 10 is connected to the tungsten wire 7 via an ammeter A1, and the shielding case 8 is grounded via an ammeter A2. Moreover, the drum 6 is connected to the positive side of a bias power source 11 and its negative side is grounded via an ammeter A3. A current Icc fed to the wire 7, a current Isc fed to the shielding case 8 and a current Ipc fed to the blank tube 6 were measured while changing the bias voltage. FIGS. 6 to 10 show results of when Icc is changed.

The results indicate that as the bias voltage to the drum 6 increases, the current Isc to the shielding case increases while the current Ipc to the drum decreases. Here, the sum of Isc and Ipc is smaller than the current Icc fed to the charger due to a discharge into the air. It will be understood from the above results that as the residual potential $V_R$ of the photosensitive material becomes greater than a predetermined reference, an effective current flowing into the photosensitive material decreases and, hence, the charged potential of the photosensitive material decreases, too.

According to the present invention, the residual potential after the discharge is lowered to satisfy the above reference by increasing the quantity of exposure at the time of discharge by exposure, which is the simplest method. It is, however, also allowable to decrease the residual potential after the discharge in a contact manner by applying a bias voltage of a polarity opposite to that of the charged potential.

Furthermore, an increase in dark attenuation by exposure discharge can be effectively prevented by using a source of monochromatic light of a spectral wavelength exhibited by the photosensitive material and by also effecting the discharge by exposure that the absorption of light ray takes place on the surface of the photosensitive material.

When the discharging is carried out in a contacting manner by applying a bias voltage of a polarity opposite to that of the charging without using light, furthermore, the potential on the surface of the drum is suppressed from being stepwisely decreased irrespective of the number of revolutions of the drum, an increase in the dark attenuation is suppressed when the image-forming cycle is repeated many times, the potential of the electrostatic image used for the developing is maintained high, the image of a high density is formed, and abrasion resistance of the photosensitive material is strikingly increased.

Figure 11:
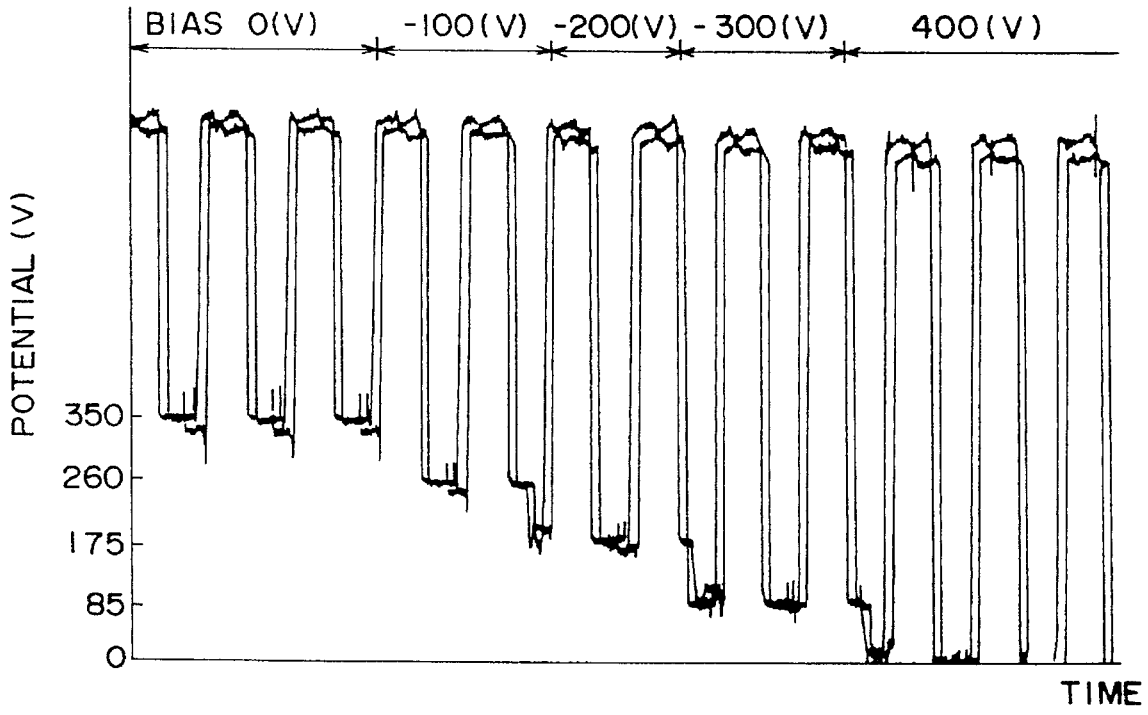
FIG. 11 is a graph showing the measured results of the charged potential and the residual potential after the discharge using the positively charged-type organic single-layer photosensitive material while changing the applied bias voltage at the time of discharging using a brush.

The accompanying drawing (FIG. 11) shows the measured results of the charged potential (upper side) and the residual potential (lower side) after the discharge using the positively charged-type organic single-layer photosensitive material while changing the applied bias voltage at the time of discharging using a brush, from which it will be understood that the residual potential is adjusted to a predetermined level by setting the bias potential.

Figure 12:
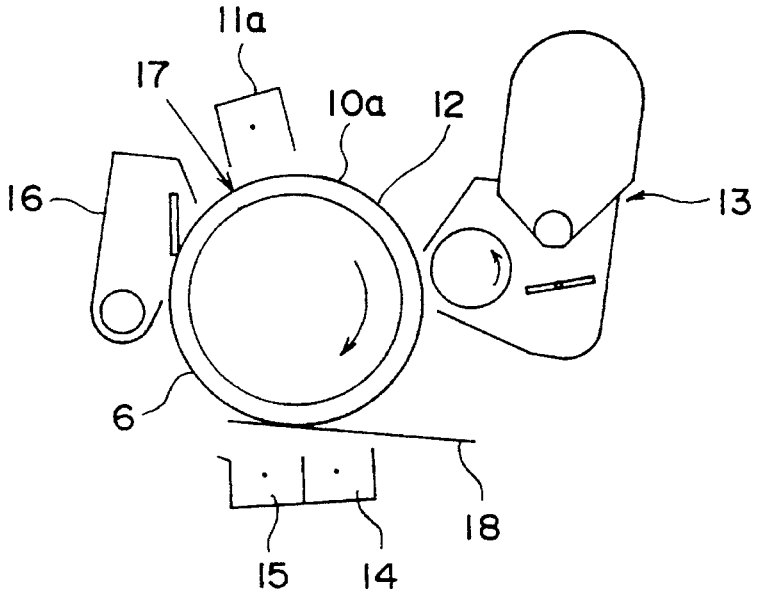
FIG. 12 is a diagram of arrangement illustrating an electrophotographic copying apparatus of the present invention, i.e., an apparatus of the type of discharge by exposure.

Referring to FIG. 12 illustrating an electrophotographic apparatus of the present invention, around the drum 6 equipped with a photosensitive layer 10*a* are arranged a corona charger 11*a* for main charging, an optical system 12 for exposing to image, a developer 13 using a one-component type developing agent or a two-component type developing agent, a charger 14 for transferring toner, a charger 15 for separating a copying paper 18, a mechanism 16 for cleaning residual toner and a source of light 17 for discharging. In this electrophotographic apparatus, the image is formed according to a process shown in FIG. 1. That is, a latent image of surface potential VD of the dark portion is developed with the toner which is charged into an opposite polarity, the toner image is transferred onto a copying paper 18 in an electric field applied by the toner-transferring charger 14, and the copying paper onto which the toner image is transferred is separated by the action of the charger 15 for separation and is sent to the subsequent processing zone such as of a thermally fixing roller (not shown). On the other hand, the toner remaining on the photosensitive layer 10 is removed by the cleaning mechanism 16 and is discharged by being exposed to light from the source of light 17.

When a light ray image such as a laser beam is used for exposure to image, a positive image can be formed by effecting the reversal developing using the toner that is charged into the same polarity as the latent image.

The photosensitive drum used in this invention is a small-diameter drum having a shorter circumferential length than ½ of the image size in the rotating direction of the drum (for example, an outer diameter of 40 mm or less, especially as short as 20 to 30 mm). The photosensitive drum and the image forming cycle are related to each other so that one image may be formed by many circumferential revolutions of the drum. Furthermore, the photosensitive drum and the image-forming cycle are so related to each other that a complete image is formed after the drum is revolved many times. For example, when the photosensitive drum has a diameter of 30 mm and an image of a size B4 is to be formed, a complete image is formed through four revolutions. When the size is A4R, a complete image is formed through six revolutions. That is, the effect of the present invention is distinctively exhibited when a complete image is to be formed through three or more revolutions.

Figure 13:
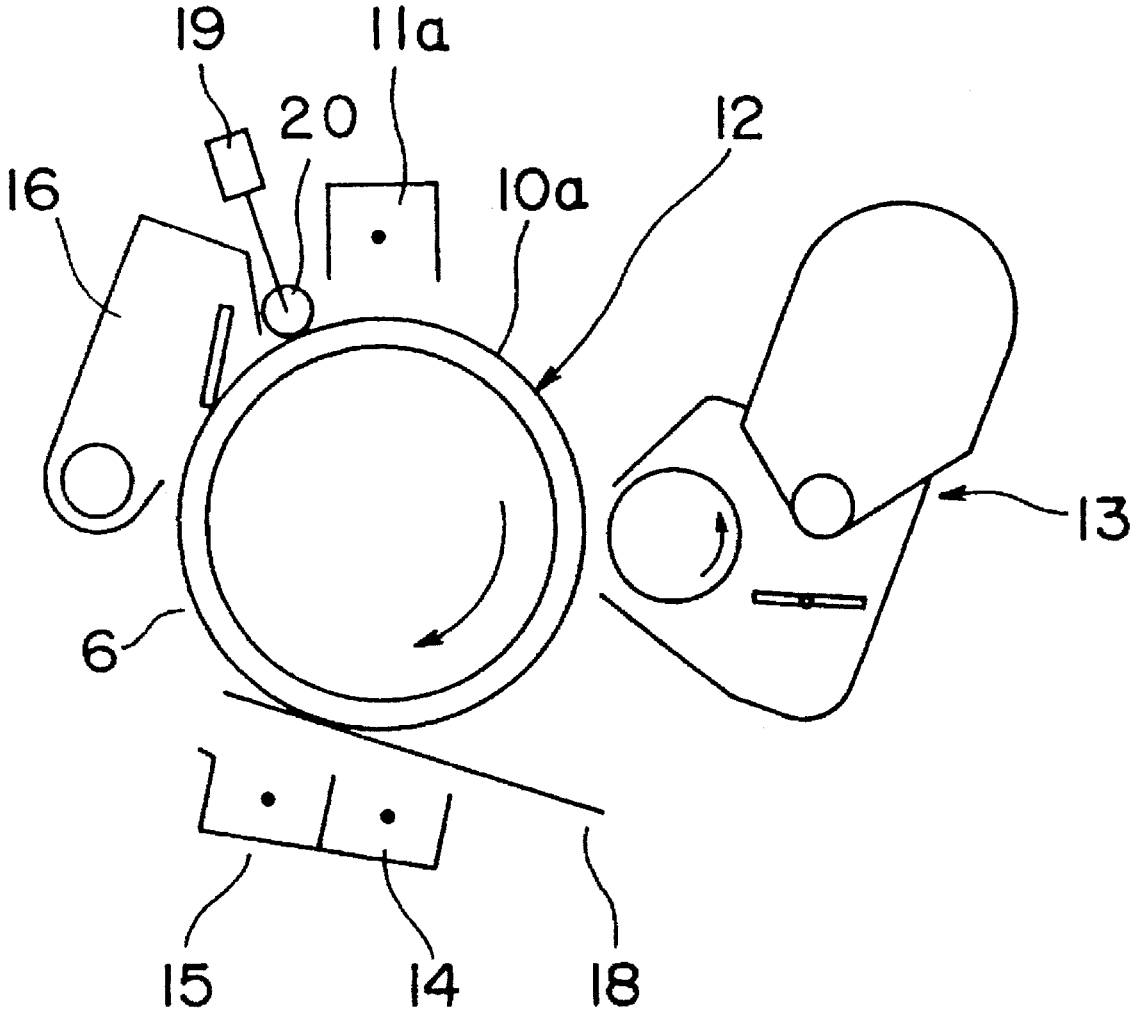
FIG. 13 is a diagram of arrangement illustrating another electrophotographic copying apparatus of the present invention, i.e., an apparatus of the type of discharge by contact.

FIG. 13 illustrates an electrophotographic apparatus according to another embodiment of the present invention. This apparatus is the same as the apparatus of FIG. 12 except the provision of a contact-type discharging mechanism 20 instead of the source of light for discharging and a bias power source 19 for applying a bias voltage of a polarity opposite to that of the charged potential of the photosensitive material.

According to the present invention, an AC discharging may be employed as a discharging mechanism in addition to the above-mentioned discharging by exposure and the contact-type discharging using a brush or a roller. As the photosensitive material, any known photosensitive material can be used such as selenium photosensitive materials (a-selenium type, selenium-tellurium alloy type, selenium-arsenic alloy type, etc.), amorphous silicon photosensitive materials and organic photosensitive materials.

As the organic photosensitive material, there can be exemplified an organic laminated-type photosensitive material obtained by laminating a charge generating layer containing a charge generating substance and a charge transporting layer containing a charge transporting substance, and an organic single-layer type photosensitive material obtained by dispersing a charge generating substance in the charge transporting medium. As the charge generating substance, any organic photoconducting pigment that has been widely known can be used. Among the pigments, it is desired to use a phthalocyanine type pigment, a perylene type pigment, a quinacridone type pigment, a pyranthrone type pigment, a dis-azo type pigment, a tris-azo type pigment and the like.

As the charge transporting medium, the one obtained by dispersing a charge transporting substance in a resin medium is used. As the charge transporting substance, there can be used any widely known positive hole transporting substance or an electron transporting substance to meet the object of the present invention. Preferred examples of the positive hole transporting substance include a poly-N-vinylcarbazole, a phenanthrene, an N-ethylcarbazole, a 2,5-diphenyl-1,3,4-oxadiazole, a 2,5-bis(4-diethylaminophenyl)-1,3,4-oxadiazole, a bis-diethylaminophenyl-1,3,6-oxadiazole, a 4,4'-bis(diethylamino)-2,2'-dimethyltriphenylmethane, a 2,4,5-triaminophenylimidazole, a 2,5-bis(4-diethylaminophenyl)-1,3,4-triazole, a 1-phenyl-3-(4-diethylaminostyryl)-5-(4-diethylaminophenyl)-2-pyrazoline, and a p-diethylaminobenzaldehyde-(diphenylhydrazone) and the like. Preferred examples of the electron transporting substance include a 2-nitro-9-fluorenone, a 2,7-dinitro-9-fluorenone, a 2,4,7-trinitro-9-fluorenone, a 2,4,5,7-tetranitro-9-fluorenone, a 2-nitrobenzothiophene, a 2,4,8-trinitrothioxanthone, a dinitroanthracene, a dinitroacridine, and a dinitroanthraquinone.

As binder resins, there can be exemplified a variety of polymers such as a styrene type polymer, a styrene-butadiene copolymer, a styrene-acrylonitrile copolymer, a styrene-maleic acid copolymer, an acrylic type polymer, a styrene-acrylic type copolymer, a styrene-vinyl acetate copolymer, a polyvinyl chloride, a polyvinyl chloride-vinyl acetate copolymer, a polyester, an alkyd resin, a polyamide, a polyurethane, an epoxy resin, a polycarbonate, a polyarylate, a polysulfone, a diallyl phthalate resin, a silicone resin, a ketone resin, a polyvinyl butyral resin, a polyether resin, a phenol resin, and photo-curing resins such as an epoxy acrylate and an urethane acrylate.

The charge generating substance should be contained in the photosensitive layer in an amount of from 0.1 to 50 parts by weight and, particularly, from 0.5 to 30 parts by weight per 100 parts by weight of the binder resin. On the other hand, the charge transporting substance should be contained in an amount of from 20 to 500 parts by weight and, particularly, from 30 to 200 parts by weight per 100 parts by weight of the binder resin. Moreover, the photosensitive layer should have a thickness of 10 to 40 μm and, particularly, from 22 to 32 μm from the standpoint of obtaining a high surface potential and good abrasion resistance and sensitivity.

As a metal substrate of drum, there is usually used an aluminum blank tube or an aluminum blank tube treated with alumite. The organic photosensitive layer is formed by dissolving the above-mentioned resin in a solvent such as an amide-type solvent, e.g., an N,N-dimethylformamide or an N,N-dimethylacetamide; a cyclic ether such as a tetrahydrofurane or a dioxane; a dimethyl sulfoxide; an aromatic solvent such as a benzene, a toluene or a xylene; ketones such as a methyl ethyl ketone and the like; an N-methyl-2-pyrrolidone; or phenols such as a phenol, a cresol and the like, followed by dispersing a charge generating substance therein to obtain a coating composition. This composition is then applied onto the electrically conducting substrate to form the organic photosensitive layer.

The present invention exhibits distinguished advantages when use is made of a positively charged-type organic single-layer photosensitive material. In this case, ozone that is generated little during the main charging gives another advantage. In the case of the positively charged-type organic single-layer photosensitive material, the charge generating substance should be a perylene type pigment, an azo type pigment or a combination thereof, and the charge transporting substance should be a diphenoquinone derivative such as a 2,6-dimethyl-2',6'-di-tert-dibutyldiphenoquinone or the like, a diamine type compound such as a 3,3'-dimethyl-N,N,N',N'-tetrakis-4-methylphenyl(1,1'-biphenyl)-4,4'-diamine or the like, a fluorene type compound, or a hydrazone type compound.

The main charging may be carried out relying upon the corona charging using a corotron or a scorotron, or by using the widely known contact-type charging apparatus with a charging brush, a charging roll or a charging blade. In general, the main charging should be so effected that the saturation charged potential ($V_S$) is from 500 to 1000 V and, particularly, from 700 to 850 V. For this purpose, the corona charger should apply a voltage of as high as from 4 to 7 KV. In the-contact-type charging, on the other hand, the charging device should be impressed with a voltage which is about 1.5 to about 3 times as great as the charge start voltage of the photosensitive material.

In the electrophotographic apparatus of the present invention, the exposure to image, developing, transfer, separation of paper and cleaning are carried out by widely known means using widely known mechanisms.

in the present invention, when the residual potential after the discharge of the first time of revolution exceeds 10% of the charged surface potential or when the residual potential after the discharge of the last time of revolution increases by more than 30% with respect to that of the first time of revolution, then a potential difference of greater than 10 V develops between the charged surface potential of the first time of revolution and the surface potential of the last time of revolution and a difference in the density develops in the solid image. It is therefore important to so set the discharging condition that the residual potential after the discharge is smaller than the above-mentioned value.

in effecting the discharge by exposure, it is desired that the quantity of light for discharging is 10 times or more and, particularly, 20 times or more as great as the half exposure quantity on the surface of the photosensitive material. As the discharging lamp, there can be used a source of visible light such as a halogen lamp, a fluorescent lamp, a cold cathode tube, a red or a green neon lamp, as well as a source of monochromatic light such as LED of red, yellow or green color.

Figure 14:
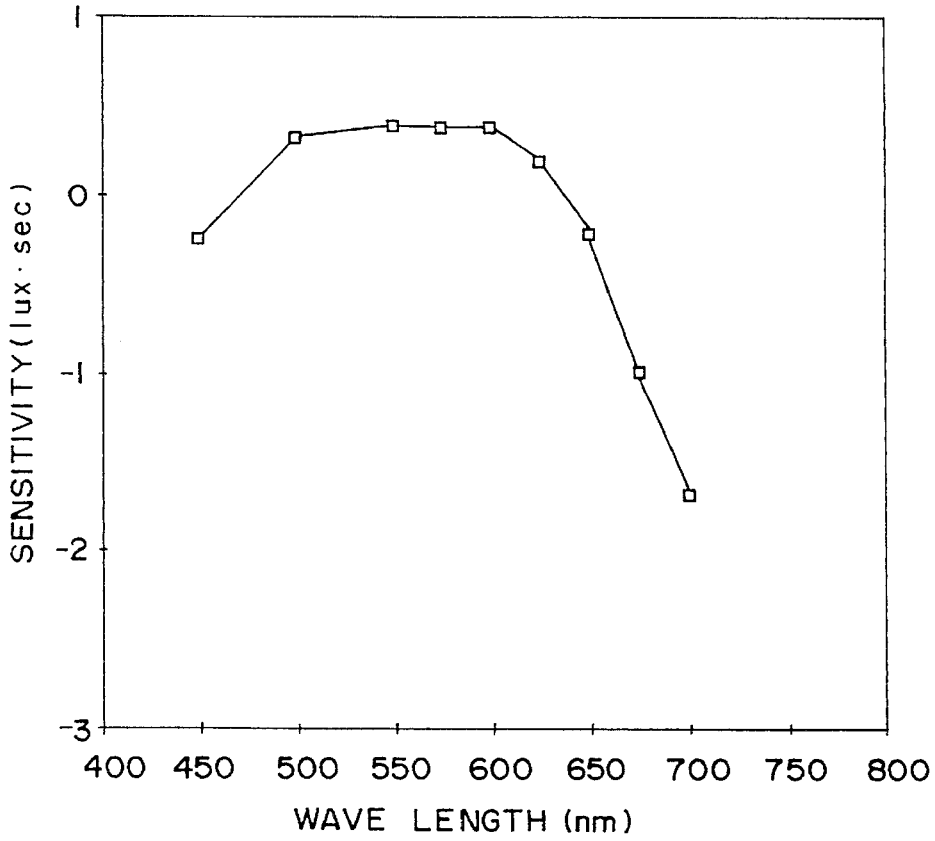
FIG. 14 is a graph illustrating the spectral sensitivity of the photosensitive drum used in Example.
Figure 15:
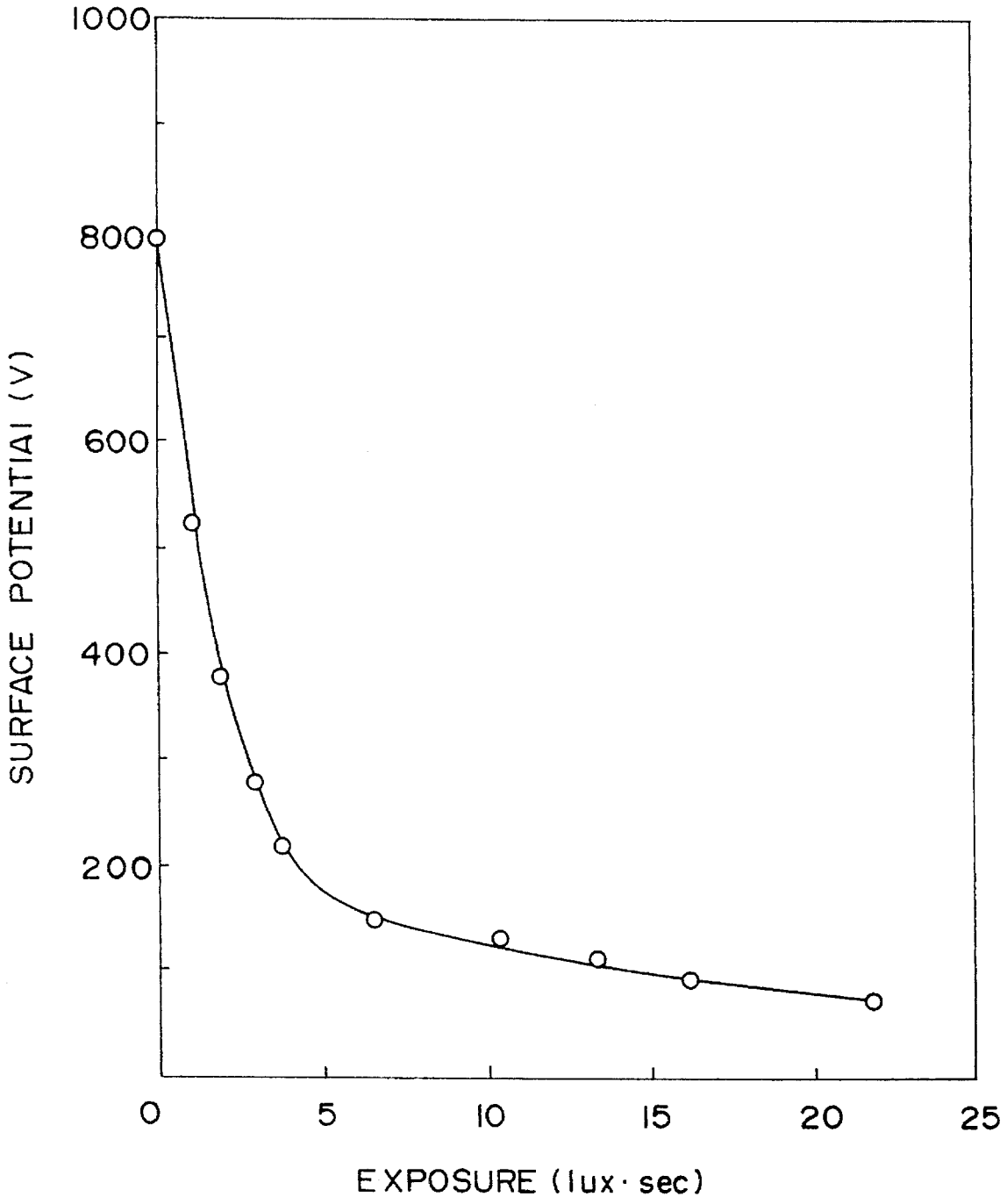
FIG. 15 is a graph illustrating a relationship between the quantity of exposure of the photosensitive drum used in Example and the surface potential.

When, for example, a discharging is used for the apparatus shown in FIG. 12 and a drum having characteristics of FIGS. 14 and 15 is used, and when SP is set to 800 V, the intensity of illumination should be 20 lux.sec or higher, and preferably 40 lux.sec or higher, and more preferably from 100 to 300 lux.sec. When the intensity of illumination exceeds 500 lux.sec, on the other hand, adverse effects result such as optical wear and the like.

When the discharging is carried out by using a source of red, yellow or green monochromatic light depending upon the spectral sensitivity characteristics of the photosensitive material, the optical wear such as an increase in the dark attenuation can be prevented even when the quantity of light for discharging is great.

The contact-type discharging uses an electrically conducting brush, roll or blade, and the discharging is effected by bringing it in contact with the photosensitive material. The electrically conducting member should, generally, have a resistivity of from $10^1$ to $10^6$ Ω.cm and will be made of a variety of resins or rubbers blended with carbon black, metal powder or electrically conducting particles such as ITO or the like.

It is desired that the bias voltage applied to the electrically conducting contact member has a polarity opposite to that of the charged potential of the photosensitive material, and has a value of, generally, 50 to 125% and, particularly, 60 to 90% of an absolute value of the charged potential of the photosensitive material.

EXAMPLES

The photosensitive material for use in the following Examples was prepared as described below.

Preparation of a single-layer type electrophotosensitive material

The following composition for a photosensitive layer was dispersed in a paint shaker for 2 hours to prepare a coating solution for forming a single-layer type photosensitive layer. The obtained coating solution was dip-applied onto the surface of an aluminum cylinder having an outer diameter of 30 mm, and was dried at 110° C. for 30 minutes to form a 30 μm-thick single-layer type photosensitive layer thereby to obtain a positively charged-type single-layer electrophotosensitive material.

| (Components) | |
|---|---|
| Bis-azo pigment (following formula (I)) | 10 parts by weight |
| 3,3'-Dimethyl-N,N,N',N'-tetrakis-4-methylphenyl-(1,1'-biphenyl)-4,4'-diamine | 100 parts by weight |
| 3,3'-Dimethyl-5,5'-di-tert-butyl-4,4'-diphenoquinone | 50 parts by weight |
| Polycarbonate resin | 150 parts by weight |
| Dicyclomethane | 800 parts by weight |

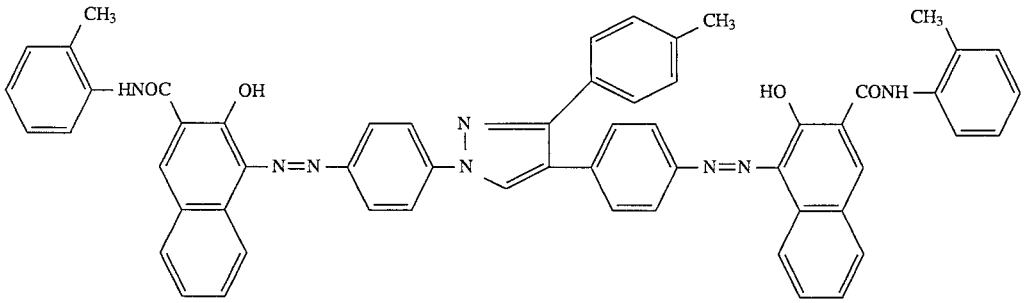

(I)

Properties of the photosensitive material were measured as follows:

(1) Method of evaluating photosensitivity.

By using a drum sensitivity tester manufactured by GENTEC Co., a voltage was applied to the photosensitive material to charge it to +800 V, the surface of the photosensitive material was irradiated with white light of a halogen lamp which is a source of light for a predetermined period of time, and the potential attenuation at this moment was observed to measure the electrophotographic properties.

Source of light: halogen lamp

Intensity of light: 147 μW/cm² (without filter)

Figure 16:
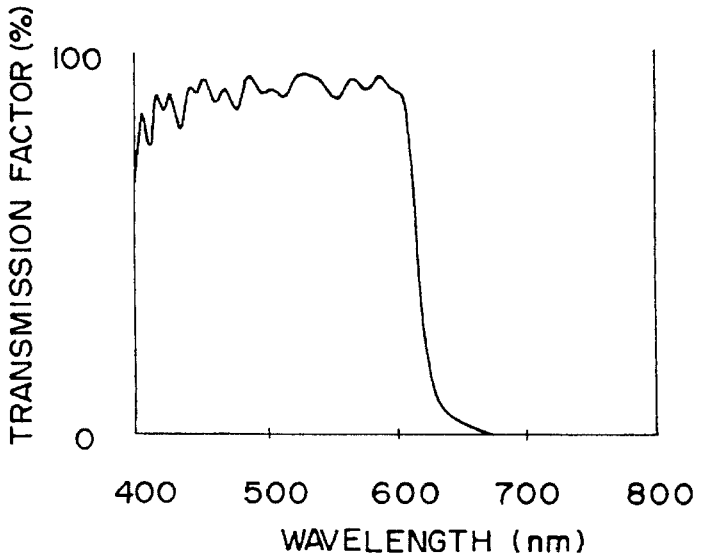
FIG. 16 is a graph showing spectral characteristics of a filter used for the measurement of FIG. 15.

Filter: having a transmission factor of 50% at 615 nm (FIG. 16 shows in detail the transmission factor of the filter)

Irradiation time: 50 msec.

Measurement of potential after exposure: 300 msec. after the start of exposure

The results were as follows:

$V_L(V)=260$, $E_{1/2}=1.8$ *lux.sec)*

$V_L(V)$ represents the surface potential of the photosensitive material 330 msec. after the start of the exposure, and $E_{1/2}$ (lux.sec) represents a half exposure quantity calculated from a time required until one-half the initial surface potential of 800 V is reached, i.e., until 400 V is reached.

(2) Method of evaluating spectral sensitivity characteristics.

Measured by using a drum tester manufactured by GENTEC Co., under the following conditions.

Drum surface potential: +800 V (potential after 380 msec of dark attenuation after charging)

Irradiation light: light of a xenon lamp is separated into a monochromatic light by a monochrometer and is then irradiated Irradiation time: 1 sec.

Intensity of light: an ND filter is so adjusted that the intensity is 10 μW/cm² on the drum surface Measurement was taken under the above-mentioned conditions while changing the wavelength of the irradiation light by 25 nm each time from 450 to 700 nm.

The results were as shown in FIG. 14 wherein the abscissa represents the wavelength of the irradiation light and the ordinate represents an inverse number of the $E_{1/2}$ (lux.sec).

(3) Method of measuring E-V characteristics.

Measured by using a drum tester manufactured by GENTEC Co., under the following conditions.

Drum surface potential: +800 V (potential after 380 msec. of dark attenuation after charging)

Source of light: halogen lamp

Filter: having a transmission factor of 50% at 615 nm (FIG. 16 shows in detail the transmission factor of the filter)

Intensity of light: varied using an ND filter

Irradiation time: 50 msec.

Measurement of potential after exposure: 300 msec. after the start of exposure

Measurement was taken under the above-mentioned conditions while changing the quantity of light. The results were as shown in FIG. 15, wherein the abscissa represents the amount of exposure without the filter and the ordinate represents the potential measured under the above-mentioned conditions.

(Examples 1 to 5 and Comparative Examples 1 to 3)

Measurement of the charged surface potential and the residual potential after the discharge The single-layer type electrophotosensitive material prepared above was mounted on the apparatus shown in FIG. 4 which is surrounded by a positive corona-charging mechanism 2, a probe 3 for detecting the surface potential, an exposure/discharge mechanism 4 and a probe 5 for detecting the residual potential after the discharge. The single-layer type electrophotosensitiv material was revolved four times under the following conditions to repeat the discharging by exposure, to measure the surface potential Vsp (V) using the probe 3 for detecting the surface potential and to measure the residual potential Vrp (V) using the probe 5 for detecting the residual potential after the discharge. The results after each revolution were as shown in Table 1.

Positive corona-charging mechanism (distance is 1 mm between the grid of the scorotron and the positively charged-type organic photosensitive drum):

By using the scorotron charging, the current was so adjusted that Examples and Comparative Examples exhibited surface potentials after the first revolution as shown in Table 1. Further, the current adjusted during the first revolution was also applied during the second to fourth revolutions.

Exposure/discharge mechanism 4 (exposed via an acrylic transparent cover maintaining a distance of 10 mm from the positively charged-type organic photosensitive drum):

By using a tungsten lamp of 24 V-11 W, the applied voltage was adjusted and an experiment was performed by charging the quantity of the irradiated light as shown in Table 1.

These results show that in Comparative Examples in which the quantity of discharged light of 13 to 17 lux.sec was used, the residual potential was high, and its increas rate was as high as 40 to 44%.

(Example 6)

Measurement was taken in the same manner as in Example 1 but by arranging a contact-type brush discharging mechanism (material: carbon fiber, bias voltage: −500 V) instead of using the exposure/discharge mechanism 4 shown in FIG. 1. The results were as shown in Table 2.

TABLE 1

| | After 1st rev. | | | After 2nd rev. | | After 3rd rev. | | After 4th rev. | | | Discharging light |
|---|---|---|---|---|---|---|---|---|---|---|---|
| | Vsp (V) | Vrp (V) | * | Vsp (V) | Vrp (V) | Vsp (V) | Vrp (V) | Vsp (V) | Vrp (V) | # | quantity (lux · sec) |
| Example 1 | 800 | 75 | 9 | 800 | 75 | 800 | 75 | 800 | 75 | 0 | 22 |
| Example 2 | 800 | 40 | 5 | 800 | 40 | 800 | 40 | 800 | 40 | 0 | 150 |
| Example 3 | 800 | 45 | 6 | 800 | 50 | 800 | 55 | 800 | 55 | 22 | 120 |
| Example 4 | 750 | 75 | 10 | 750 | 75 | 750 | 75 | 750 | 75 | 0 | 20 |
| Example 5 | 750 | 45 | 6 | 750 | 58 | 750 | 58 | 750 | 58 | 29 | 110 |
| Comparative Example 1 | 750 | 100 | 13 | 740 | 120 | 720 | 130 | 720 | 140 | 40 | 13 |
| Comparative Example 2 | 850 | 100 | 12 | 830 | 115 | 800 | 125 | 800 | 140 | 40 | 17 |
| Comparative Example 3 | 800 | 90 | 11 | 780 | 100 | 750 | 120 | 750 | 130 | 44 | 17 |

*represents values obtained according to:

$$\frac{\text{Residual potential after discharge of the first revolution}}{\text{Charged surface potential after the first revolution}} \times 100$$

#represents values obtained according to:

$$\left| \frac{\text{Residual potential after discharge of the fourth revolution}}{\text{Residual potential after discharge of the first revolution}} - 1 \right| \times 100$$

TABLE 2

| | After 1st rev. | | | After 2nd rev. | | After 3rd rev. | | After 1st rev. | | |
|---|---|---|---|---|---|---|---|---|---|---|
| | Vsp (V) | Vrp (V) | * | Vsp (V) | Vrp (V) | Vsp (V) | Vrp (V) | Vsp (V) | Vrp (V) | # |
| Example 6 | 800 | 35 | 4 | 800 | 35 | 800 | 35 | 800 | 35 | 0 |

*represents values obtained according to:

$$\frac{\text{Residual potential after discharge of the first revolution}}{\text{Charged surface potential after the first revolution}} \times 100$$

#represents values obtained according to:

$$\left| \frac{\text{Residual potential after discharge of the fourth revolution}}{\text{Residual potential after discharge of the first revolution}} - 1 \right| \times 100$$

From these results, when a brush was used a discharge means and –500 V having inverse polarity to the photosensitive material was impressed, the residual potential was small and the increase rate was zero to give results.

(Examples 7 and 8 and Comparative Example 4)

Instead of the tungsten lamp used in Example 1, a light-emitting diode (monochromatic) was used as a discharging light source in conducting the same experiment. The results are shown in Table 3. The half exposure quantity of the photosensitive material when this light source was used was 1.6 Luc.sec.

This results shows that when monochromatic light was used, the increase of the residual potential in the fourth revolution was small, and it was effective.

TABLE 3

| | After 1st rev. | | | After 2nd rev. | | After 3rd rev. | | After 4th rev. | | | Discharging light |
|---|---|---|---|---|---|---|---|---|---|---|---|
| | Vsp (V) | Vrp (V) | * | Vsp (V) | Vrp (V) | Vsp (V) | Vrp (V) | Vsp (V) | Vrp (V) | # | quantity (lux · sec) |
| Example 7 | 800 | 40 | 5 | 800 | 40 | 800 | 40 | 800 | 40 | 0 | 100 |
| Example 8 | 800 | 70 | 9 | 800 | 75 | 800 | 80 | 800 | 80 | 14 | 40 |
| Comparative Example 4 | 800 | 100 | 13 | 770 | 105 | 765 | 110 | 760 | 115 | 15 | 20 |

SLR-54MC made by POHM Co., Ltd. was used as a discharge light source. (Light-emitting peak wavelength 565 nm)

*represents values obtained according to:

$$\frac{\text{Residual potential after discharge of the first revolution}}{\text{Charged surface potential after the first revolution}} \times 100$$

#represents values obtained according to:

$$\left| \frac{\text{Residual potential after discharge of the fourth revolution}}{\text{Residual potential after discharge of the first revolution}} - 1 \right| \times 100$$

According to the electrophotographic apparatus of the present invention which employs a photosensitive drum of a small outer diameter drum having a circumferential length shorter than ½ of image size in the drum rotating direction and forms a complete image by revolving the photosensitive drum many times, the amount of discharge is so set that the residual potential after the discharge is smaller than a predetermined value, whereby the image density is suppressed from being stepwisely decreased depending upon the number of revolutions of the drum, and the complete image exhibits improved uniformity in the density and improved image quality.

Moreover, even when the image-forming cycle is repeated many times by applying a bias voltage of a polarity opposite to that of the charged potential and by effecting the contact-discharging, the surface potential is markedly suppressed from being decreased by the dark attenuation, and the abrasion resistance is greatly improved.

It is thus made possible to greatly decrease the size of the apparatus as a whole, to greatly decrease the area for installation and volume thereof and, hence, to easily incorporate the apparatus in a facsimile, in a laser printer or in like devices.

We claim:

1.An electrophotographic apparatus for forming a copy image on a sheet, said apparatus consisting of:

a rotatable, electrically chargeable, photosensitive drum; said photosensitive drum comprising an outer photosensitive layer having an outer diameter such that a circumferential length of said drum, in a drum rotating direction, is less than one-half of a sheet size in said drum rotating direction whereby a copy image is formed on a sheet after said drum has rotated a plurality of times; and in the following order, said order being along a direction of rotation of said photosensitive drum, a main electrical charger for producing a charged surface potential on said outer photosensitive layer of said photosensitive drum, an optical image exposing mechanism, a developer mechanism, a toner transfer charger, a sheet separating charger, a toner cleaning member, and a discharge means for, in the formation of a copy image on a single sheet, discharging said photosensitive layer so that a residual potential of said photosensitive layer is 10% or less of said charged surface potential after the discharge on a first rotation of said photosensitive drum and an increase in said residual potential is not more than 30% after the discharge on a last rotation of said photosensitive drum.

2. The electrophotographic apparatus according to claim 1, wherein said photosensitive layer is composed of a positively charged single layer organic photosensitive material.

3. The electrophotographic apparatus according to claim 1, wherein said photosensitive layer comprises a charge generating substance dispersed in a charge transporting medium.

4. The electrophotographic apparatus according to claim 1, wherein a copy image is formed on a sheet after said drum has rotated three or more times.

5. The electrophotographic apparatus according to claim 1, wherein said discharge means comprises a tungsten lamp producing an intensity of illumination of at least 20 lux.sec.

6. The electrophotographic apparatus according to claim 1, wherein said discharge means comprises an electrode contacting said photosensitive layer with a bias voltage applied to said electrode, said bias voltage being of a polarity opposite to that of said charged surface potential of said photosensitive layer and of a magnitude of 50 to 125% of an absolute value of said charged surface potential of said photosensitive layer.

7. In a method for forming a copy image on a sheet comprising subjecting a rotatable photosensitive drum to electrical charging to produce a charged surface potential thereon, to image-wise exposure to a source of light and to electrical discharging, upon each rotation of said drum, wherein said photosensitive drum has an outer diameter such that a circumferential length thereon in a drum rotating direction is less than one-half of a length of said sheet, whereby a copy image is formed on a single sheet after said drum has rotated a plurality of times, the improvement comprising discharging said drum so that a residual potential thereon is 10% or less of said charged surface potential after the discharge on a first rotation in the production of a copy image and an increase in the residual potential is not more than 30% after the discharge on a last rotation in the production of a copy image.

8. The method according to claim 7, wherein said photosensitive drum is charged to produce a charged surface potential of 500 to 1000 volts.

9. The method according to claim 7, wherein said discharging is effected by exposure to light of a quantity of 10 or more times as great as a half exposure quantity of said photosensitive drum.

10. The method according to claim 7, wherein said discharging is effected by exposure to light of a quantity of 20 lux.sec or more.

11. The method according to claim 7, wherein said discharging is effected by exposure to monochromatic light of a spectral wavelength exhibited by the photosensitive drum.

12. The method according to claim 7, wherein said discharging is effected by contact with an electrode charged with a bias voltage of a polarity opposite to that of said charged surface potential.

* * * * *